United States Patent [19]

Schmolmann et al.

[11] 4,443,506

[45] Apr. 17, 1984

[54] BULLETPROOF ARRANGEMENT OF WOVEN, KNITTED OR THE LIKE FABRICS

[75] Inventors: Horst Schmolmann; Renate Schmolmann née Holstein, both of Friedrichsholm, Fed. Rep. of Germany

[73] Assignee: Interglas-Textil GmbH., Ulm, Fed. Rep. of Germany

[21] Appl. No.: 450,578

[22] Filed: Dec. 17, 1982

[30] Foreign Application Priority Data

Dec. 22, 1981 [DE] Fed. Rep. of Germany ..... 3150725

[51] Int. Cl.[3] ..... B32B 3/04; B32B 3/26

[52] U.S. Cl. ..... 428/102; 428/181; 428/193; 428/245; 428/252; 428/253; 428/902; 428/911

[58] Field of Search ..... 428/181, 245, 252, 253, 428/902, 911, 193, 102

[56] References Cited

U.S. PATENT DOCUMENTS

| | | | |
|---|---|---|---|
| 3,725,173 | 4/1973 | Johnson et al. | 428/911 |
| 4,090,005 | 5/1978 | Morgan | 428/911 |
| 4,179,979 | 12/1979 | Cook et al. | 428/911 |
| 4,200,677 | 4/1980 | Bottini et al. | 428/911 |

*Primary Examiner*—James J. Bell
*Attorney, Agent, or Firm*—John C. Smith, Jr.

[57] ABSTRACT

A bulletproof arrangement of woven, knitted or the like fabrics comprised of highly strong fibers comprises at least one continuous material web which forms a plurality of folds which overlap one another like fish-scales. The distances between the edges of the folds are dimensioned smaller than the caliber of a high velocity projectile impacting thereupon, so that the projectile is deflected in the bulletproof arrangement in the sense of a ricochet effect and is thereby kept off an object to be protected.

14 Claims, 4 Drawing Figures

BULLETPROOF ARRANGEMENT OF WOVEN, KNITTED OR THE LIKE FABRICS

BACKGROUND OF THE INVENTION

This invention relates to a bulletproof arrangement of woven, knitted or the like fabrics comprised of highly strong fibers such as aromatic polyamide fibers (aramide fibers).

It is already known to use highly strong fibers of this kind of bulletproof protective clothing. Corresponding to the respective requirements linings and insertions of hard materials such as metal, plastics material and ceramics in the form of plates and platelets are additionally provided in order to attain the desired protective effect.

It is furthermore known to increase the protective effect against the kinetic energy of a high velocity projectile impacting upon a protective clothing by larger dimensioning the said protective clothing, However, the increased volume and weight of the protective clothing result in a reduced movability of the wearer of this clothing.

Light protective vests of a fabric of aramide fibers have become known which are usable for a protection against projectiles having a kinetic energy of 500 joules =51 mkp when leaving the barrel. Higher efficiencies have up to now only been able to be achieved in the case of light protective vests by increasing the number of fabric layers or by the insertion of hard materials. This results, however, in dimensions of the vests the volume and weight of which have detrimental effects on the movability of the wearer. This is also true when more aramide fibers are used, such a vest having a weight of about 10 to 12 kp.

SUMMARY OF THE INVENTION

It is, therefore, the object of the present invention to avoid the above-mentioned disadvantages and to provide a bulletproof arrangement of woven, knitted or the like fabrics which has over the known vests a reduced volume and thus a reduced weight and ensures in a simple manner an increase of the protective effect.

To attain this object the present invention provides a bulletproof arrangement of woven, knitted or the like fabrics comprised of highly strong fibers, such as aromatic polyamide fibers (aramide fibers), comprising at least one continuous material web forming a plurality of folds which overlap one another like fish scales, said folds forming edges having distances between one another which are smaller than the caliber of a projectile impacting upon the bulletproof arrangement.

The advantage of this bulletproof arrangement is that a structure is provided which is smaller in volume and in weight than the known bulletproof arrangements. A projectile, independent of its angle of incidence, is forced by the edges of the folds to substantial changes in direction from the firing direction predetermined via the line of sight. By the continuing changes in direction of the projectile the kinetic energy is dissipated until the projectile stops after a relatively short distance in or between the folds. In the same manner impact forces are transferred into directions which result from the changes in direction of the projectile so that, because of the special design of the bulletproof arrangement of the invention, the braking action on the projectile is increased and the resilient deformations of the fabric are decreased and the projectile is conducted away from the body to be protected so that impact injuries become less or insignificant.

In particular, parallely arranged material webs as well as folds connected to underlayers as compact fold systems result in a kinetic absorption of energy which may be increased by further layers arranged one above the other. With the bulletproof arrangement proposed by the invention a behavior of the projectile is caused which in a comparison may be described as ricochet effect, the kinetic energies of the projectiles being absorbed in the folded layers becoming forced paths with substantially more efficiency than with the soft processes known up to now.

The use of the bulletproof arrangement proposed by the invention is not limited to protective clothing since also a use in the form of protective mats or sheets for objects and surfaces is feasible.

BRIEF DESCRIPTION OF THE DRAWINGS

Some preferred embodiments of the invention will now be described by way of example and with reference to the accompanying schematic drawings. For clarification purposes, the drawings are perspective views, on an enlarged scale, and the distances do not correspond to reality. The drawings show.

DESCRIPTION OF THE PREFERRED EMBODIMENTS

Figure 1:
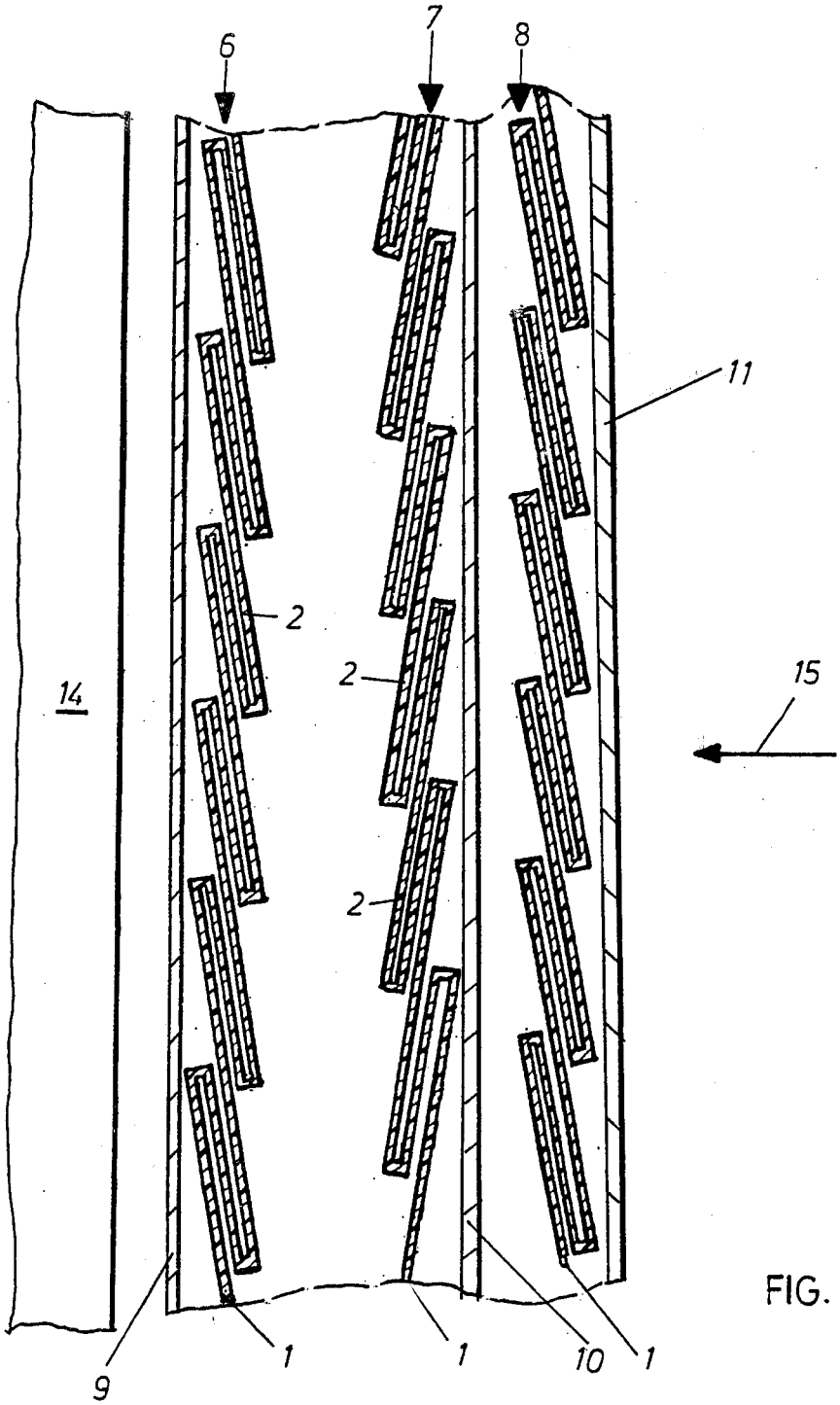
FIG. 1 a bulletproof arrangement with three parallely arranged folded material webs according to the invention.
Figure 3:
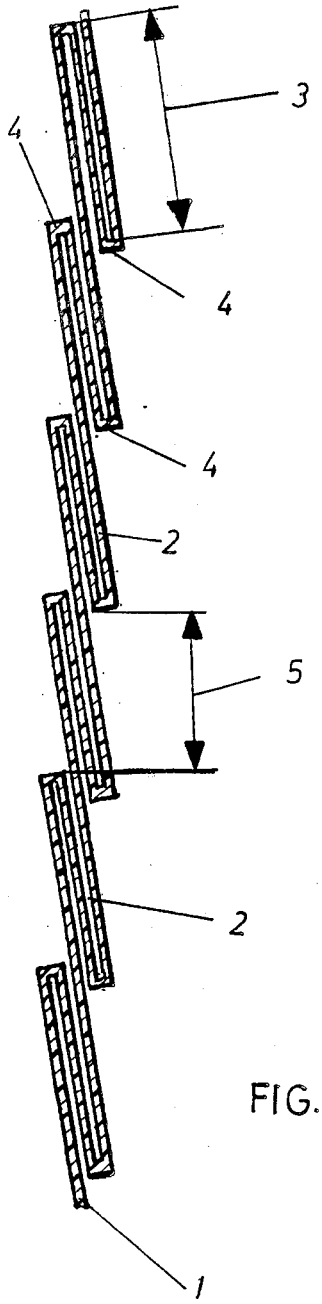
FIG. 3 an individual folded material web.

FIG. 1 shows a bulletproof arrangement of woven, knitted or the like fabrics having three continuous material webs 1 comprised of highly strong fibers such as aromatic polyamide fibers (aramide fibers). Each material web 1 forms a plurality of folds 2 forming panels which overlap one another like fish-scales so that a flat element is provided, the depth 3 (FIG. 3) of the folds 2 determining the degree of overlap. The edges 4 of the folds 2 are arranged at a distance 5 from one another. The distance 5 is dimensioned smaller than the caliber of high velocity projectiles so that each projectile impacting upon the bulletproof arrangement strikes at least one of the edges 4 of a fold.

Figure 2:
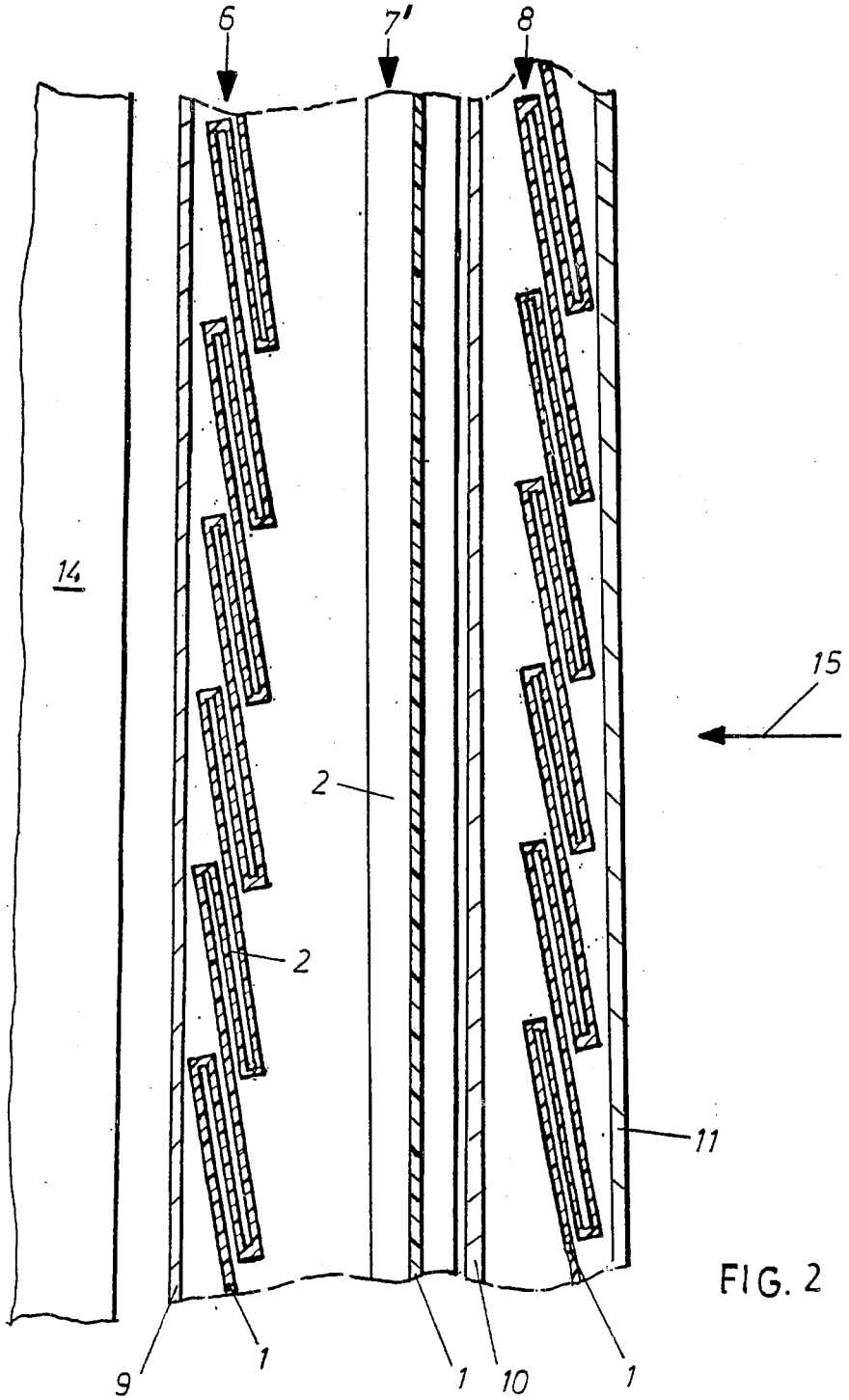
FIG. 2 an arrangement corresponding to FIG. 1, the folds of the central material web being turned by 90° relative to the folds of the other material webs.
Figure 4:
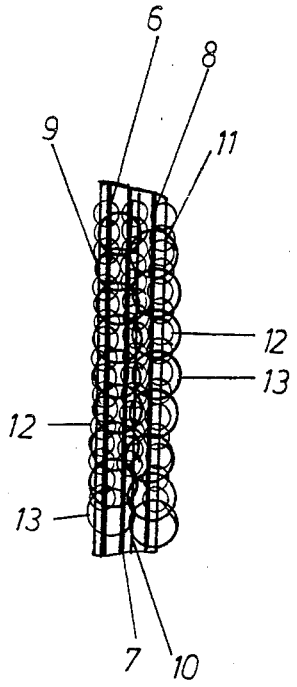
FIG. 4 an arrangement corresponding to FIG. 1 in a simplified form and on a reduced scale, the folded material webs each being sewed onto an underlayer and the individual material webs being joined together by sewing.

According to FIGS. 1 and 2, three folded material webs 6, 7 and 8 are arranged. In FIG. 2 a central material web 7' is provided which has its folds 2 offset by 90° relative to the folds 2 of the other material webs 6 and 8. In these embodiments the individual folded material webs 6, 7 and 8 are arranged on a respective underlayer 9, 10 and 11 and are connected in each case to one another in a sewing operation by a thread 12 (FIG. 4). The elements formed in this manner are again connected to one another by sewing with a thread 13 as is also shown in FIG. 4. It is of course also possible to effect the connections in a different manner, e.g. by adhesive means or welding.

In use the bulletproof arrangement is arranged as a protection in front of a body 14. The direction of firing is indicated by an arrow 15.

Each of the material webs 6, 7 and 8 attached to the underlayers 9, 10 and 11 forms a fold system which can be produced in any required widths and lengths.

The invention may be embodied in other specific forms without departing from the spirit or essential characteristics thereof. The embodiments are therefore to be considered in all respects as illustrative and not restrictive.

What is claimed is:

1. A bulletproof arrangement of woven or knitted fabric material comprised of aromatic polyamide fibers, comprising:

(a) at least one continuous web of said fabric material;

(b) said web being folded at spaced intervals in a zigzag configuration forming a succession of panels, each panel comprising three layers of said web and having a first fold line between the first and second layers of said web and a second fold line between the second and third layers of said web;

(c) said third layer of said web in one panel extending to form the first layer of said web of the next succeeding panel;

(d) the distance between the second fold line of one panel and the first fold line of the next succeeding panel being greater than, but less than twice, the distance between the first and second fold lines of said panels such that said panels partially overlap; and (e) the distance between the first fold line of one panel and the second fold line of the panel next succeeding the next succeeding panel being less than the caliber of a projectile impacting upon the bulletproof arrangement.

2. An arrangement as claimed in claim 1 wherein the distances between the first and second fold lines of said panels are equal.

3. An arrangement as claimed in claim 1 wherein the distances between the first and second fold lines of said panels are different.

4. An arrangement as claimed in claim 1 wherein the distances between the first fold line of a panel and the second fold line of a panel next succeeding a next succeeding panel are equal.

5. An arrangement as claimed in claim 1 wherein the distances between the first fold line of a panel and the second fold line of a panel next succeeding a next succeeding panel are different.

6. An arrangement as claimed in claim 1 comprising a plurality of said continuous webs arranged substantially parallel to one another.

7. An arrangement as claimed in claim 6 wherein the panels of one of said plurality of said continuous webs are oriented in a different direction from the panels of another of said plurality of said continuous webs.

8. An arrangement as claimed in claim 1 further comprising at least one underlayer web and means for securing one of said at least one folded continuous web thereto.

9. An arrangement as claimed in claim 8 wherein said securing means is thread.

10. An arrangement as claimed in claim 8 wherein said securing means is adhesive.

11. An arrangement as claimed in claim 8 wherein said securing means is welding.

12. An arrangement as claimed in claim 1 wherein the fibers of said at least one continuous web of fabric material are impregnated.

13. An arrangement as claimed in claim 1 wherein the fibers of said at least one continuous web of fabric material are provided with a protective cover.

14. An arrangement as claimed in claim 1 wherein said at least one continuous web of said fabric material is provided with means for the reception of insertable protective elements.

* * * * *